US011465417B2

(12) United States Patent
Eto et al.

(10) Patent No.: US 11,465,417 B2
(45) Date of Patent: Oct. 11, 2022

(54) LIQUID DISCHARGE HEAD SUBSTRATE, METHOD OF MANUFACTURING THE SAME, LIQUID DISCHARGE HEAD, AND LIQUID DISCHARGE APPARATUS

(71) Applicant: CANON KABUSHIKI KAISHA, Tokyo (JP)

(72) Inventors: Toru Eto, Yokohama (JP); Keiichi Sasaki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/100,260

(22) Filed: Nov. 20, 2020

(65) Prior Publication Data

US 2021/0070048 A1 Mar. 11, 2021

Related U.S. Application Data

(63) Continuation of application No. 16/342,097, filed as application No. PCT/JP2018/002188 on Jan. 25, 2018, now Pat. No. 10,899,129.

(30) Foreign Application Priority Data

Feb. 17, 2017 (JP) ..... JP2017-028421
Nov. 14, 2017 (JP) ..... JP2017-219330

(51) Int. Cl.
*B41J 2/16* (2006.01)
*B41J 2/14* (2006.01)

(52) U.S. Cl.
CPC ..... *B41J 2/1623* (2013.01); *B41J 2/14129* (2013.01); *B41J 2/1603* (2013.01);
(Continued)

(58) Field of Classification Search
CPC .... B41J 2/1623; B41J 2/14129; B41J 2/1603; B41J 2/1628; B41J 2/1629; B41J 2/1639;
(Continued)

(56) References Cited

U.S. PATENT DOCUMENTS 6,435,653 B1 8/2002 Boyd et al.
8,579,418 B2 11/2013 Enomoto et al.
(Continued)

FOREIGN PATENT DOCUMENTS

CN 105793044 A 7/2016
JP 11-10882 A 1/1999
(Continued)

OTHER PUBLICATIONS

IP.com search (Year: 2022).*
(Continued)

*Primary Examiner* — Lisa Solomon
(74) *Attorney, Agent, or Firm* — Venable LLP

(57) ABSTRACT

A method of manufacturing a liquid discharge head substrate is provided. The method includes forming a first substrate that includes a semiconductor element and a first wiring structure; forming a second substrate that includes a liquid discharge element and a second wiring structure; and bonding the first wiring structure and the second wiring structure such that the semiconductor element and the liquid discharge element are electrically connected to each other after the forming the first substrate and the second substrate.

20 Claims, 14 Drawing Sheets

(52) U.S. Cl.
CPC ..... *B41J 2/1628* (2013.01); *B41J 2/1629* (2013.01); *B41J 2/1639* (2013.01); *B41J 2202/13* (2013.01)

(58) Field of Classification Search
CPC ..... B41J 2202/13; B41J 2202/18; B41J 2/16; B41J 2/1632
See application file for complete search history.

(56) References Cited

U.S. PATENT DOCUMENTS

| | | | |
|---|---|---|---|
| 9,073,318 | B2 | 7/2015 | Koshikawa et al. |
| 9,919,524 | B2 | 3/2018 | Chen et al. |
| 10,035,346 | B2 | 7/2018 | Kasai et al. |
| 10,232,619 | B2 | 3/2019 | Chen et al. |
| 2002/0033861 | A1 | 3/2002 | Boyd et al. |
| 2003/0210301 | A1 | 11/2003 | Seabridge et al. |
| 2007/0211108 | A1 | 9/2007 | Enomoto et al. |
| 2008/0165222 | A1 | 7/2008 | Hayakawa et al. |
| 2011/0277319 | A1* | 11/2011 | Enomoto ..... B41J 2/14233 29/831 |
| 2014/0322835 | A1 | 10/2014 | Koshikawa et al. |
| 2015/0290935 | A1 | 10/2015 | Tamatsukuri et al. |
| 2015/0343768 | A1 | 12/2015 | Koda |
| 2016/0009088 | A1 | 1/2016 | Nagamochi et al. |
| 2017/0028722 | A1 | 2/2017 | Chen et al. |
| 2018/0154632 | A1 | 6/2018 | Chen et al. |
| 2018/0370233 | A1 | 12/2018 | Kasai et al. |

FOREIGN PATENT DOCUMENTS

| | | | |
|---|---|---|---|
| JP | 2001-341316 | A | 12/2001 |
| JP | 2007-230060 | A | 9/2007 |
| JP | 2014-213575 | A | 11/2014 |
| JP | 2016-137705 | A | 8/2016 |
| JP | 2016-221703 | A | 12/2016 |
| WO | 2014/132615 | A1 | 9/2014 |
| WO | 2015/080033 | A1 | 6/2015 |

OTHER PUBLICATIONS

Office Action dated Feb. 20, 2021, in counterpart application CN 201880011541.0 (13 pages).
Office Action dated Jun. 23, 2020, in counterpart application CN 201880011541.0 (10 pages).
IP.com search cited on Apr. 15, 2020, PTO-892 in U.S. Appl. No. 16/342,097, filed 2020.
P.com search2 cited on Apr. 15, 2020, PTO-892 in U.S. Appl. No. 16/342,097, filed 2020.
Extended European Search Report dated Nov. 17, 2020, in counterpart application EP 18753582.8 (8 pages).

* cited by examiner

[Fig. 1A]
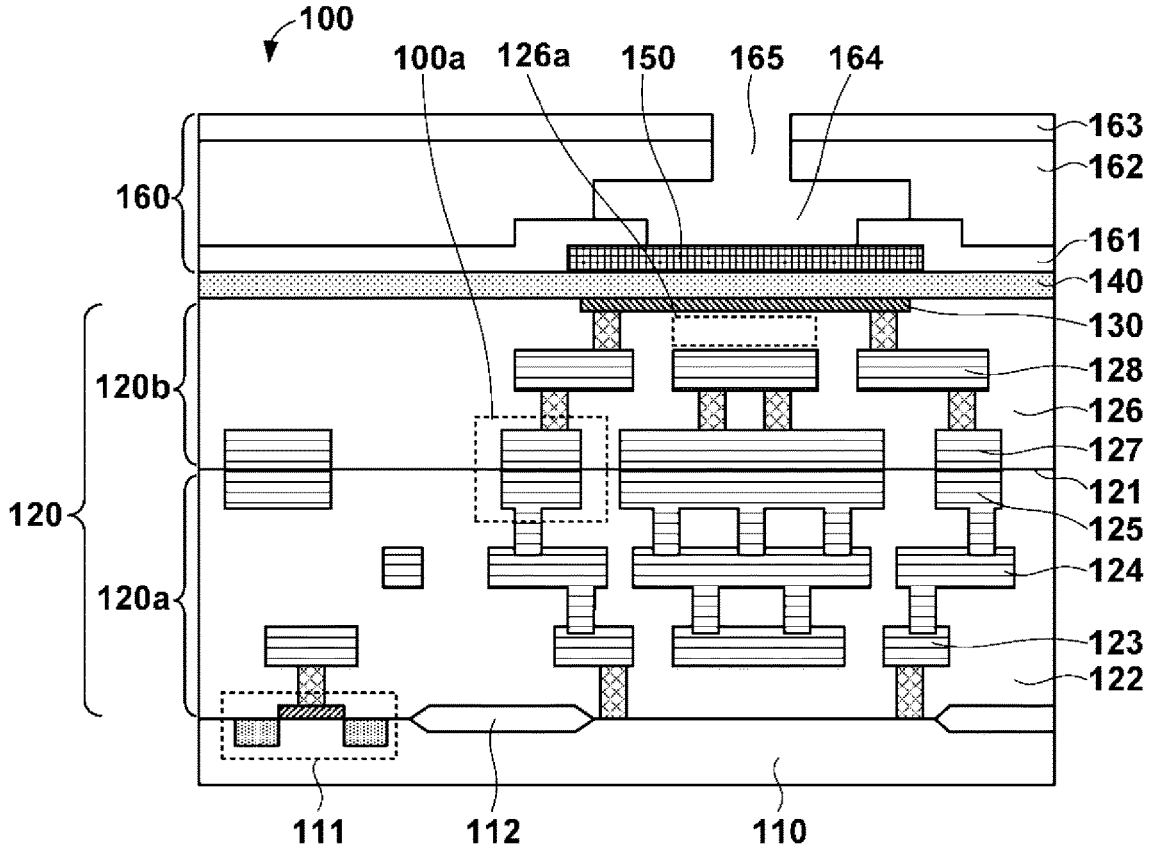
[Fig. 1B]
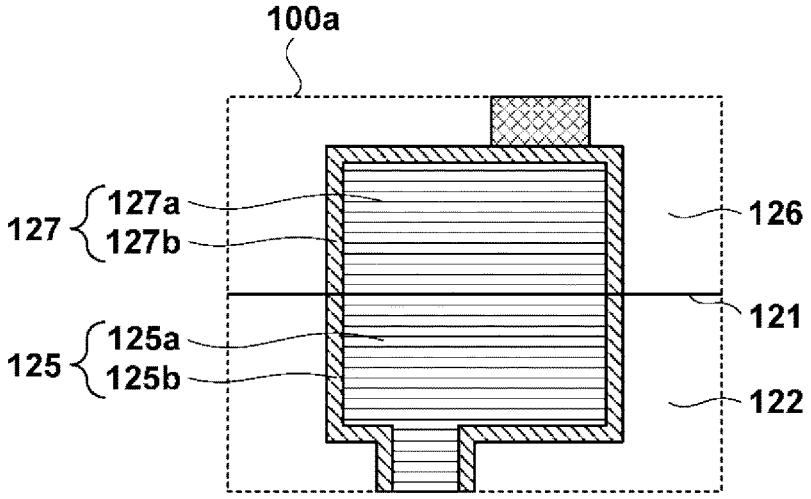

[Fig. 2A]
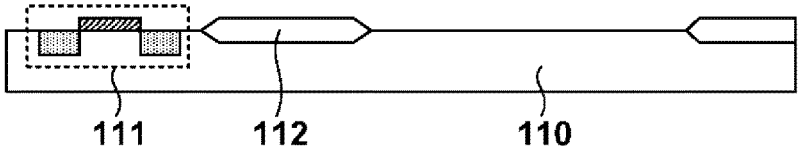
[Fig. 2B]
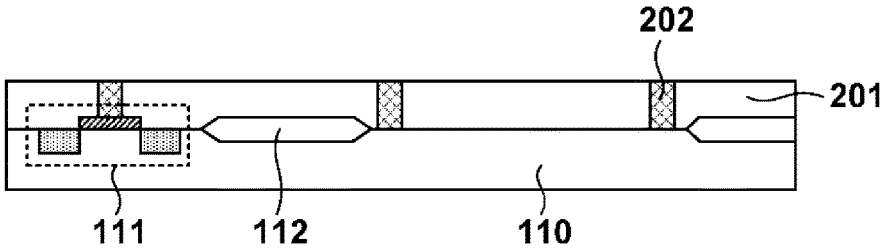
[Fig. 2C]
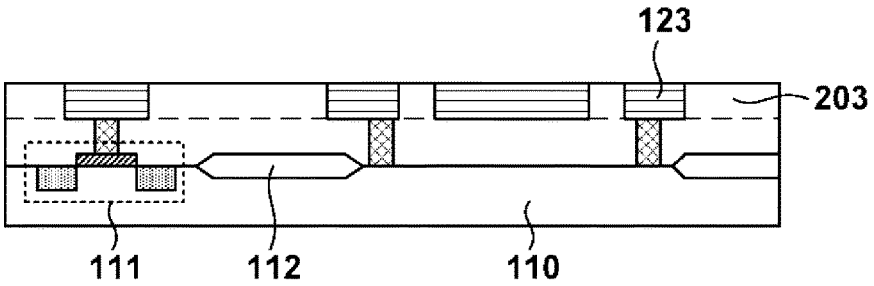
[Fig. 2D]
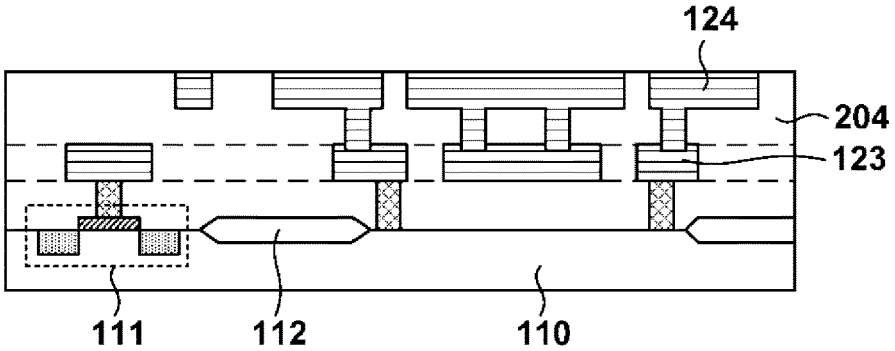
[Fig. 2E]
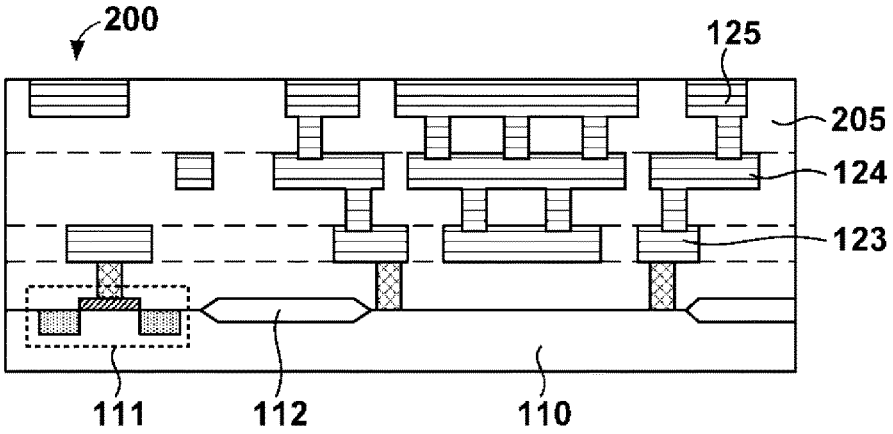

[Fig. 3A]
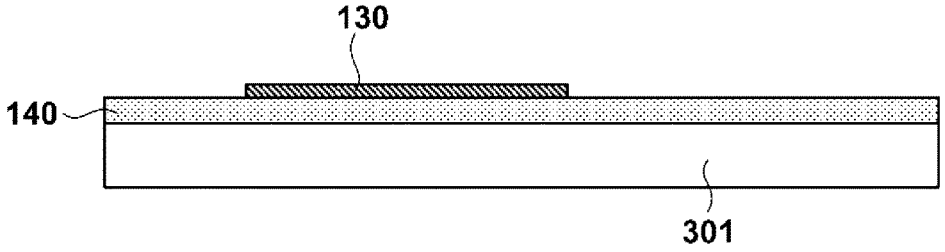
[Fig. 3B]
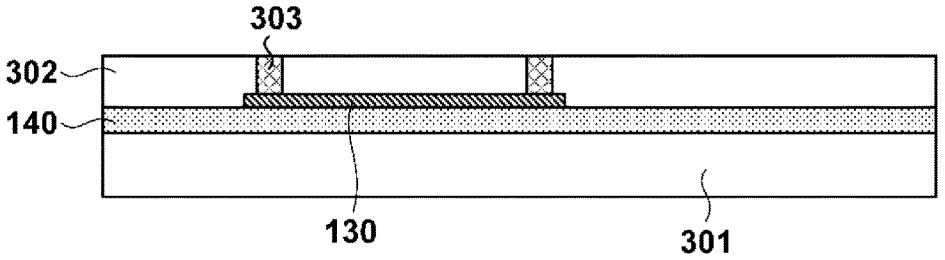
[Fig. 3C]
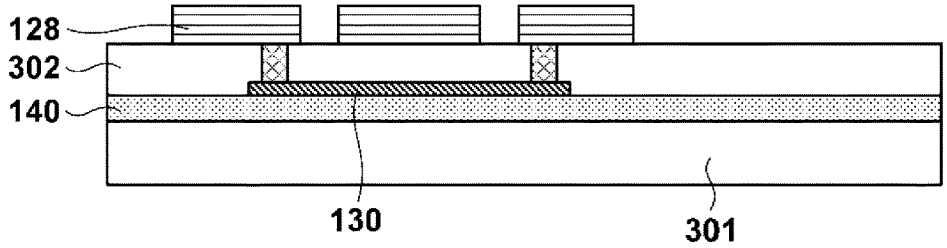
[Fig. 3D]
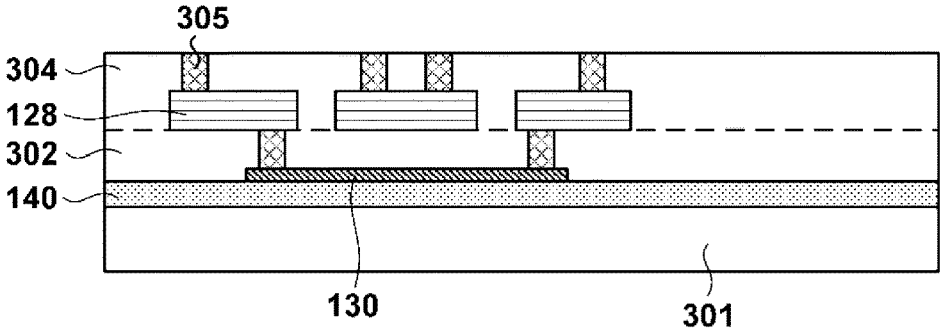
[Fig. 3E]
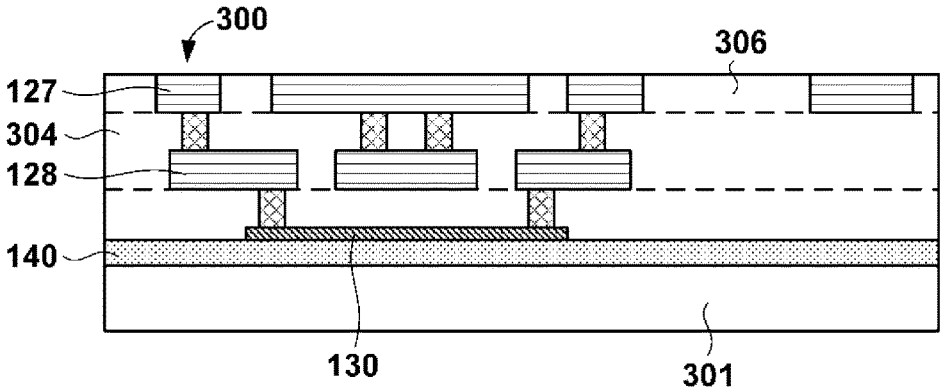

[Fig. 4A]
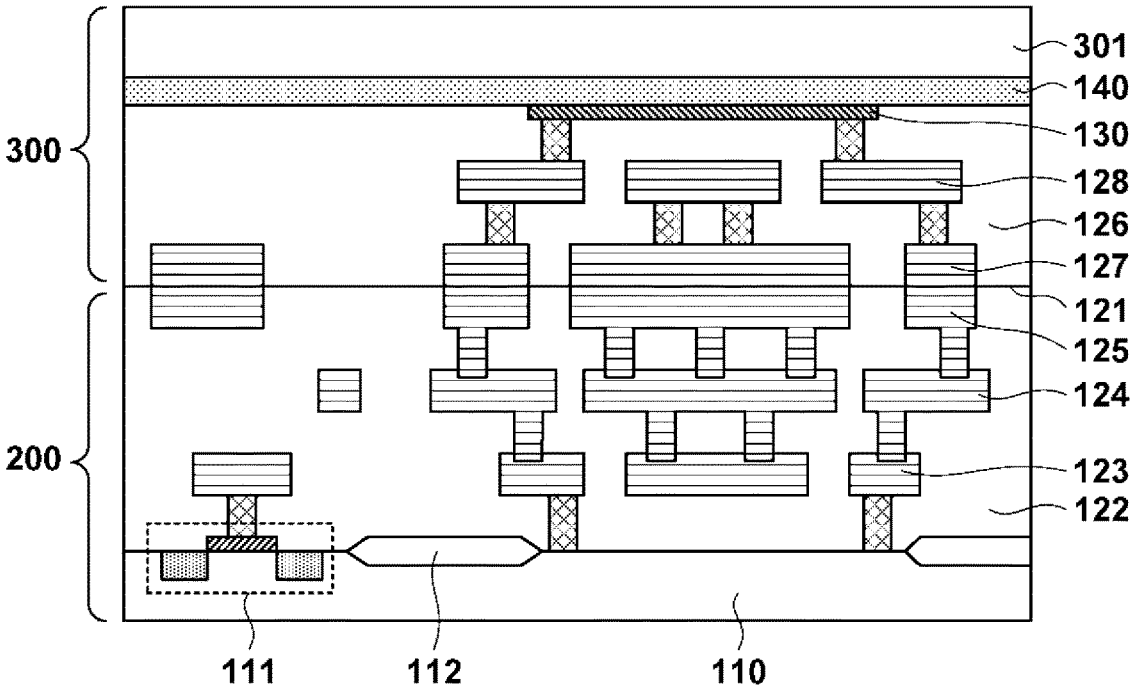
[Fig. 4B]
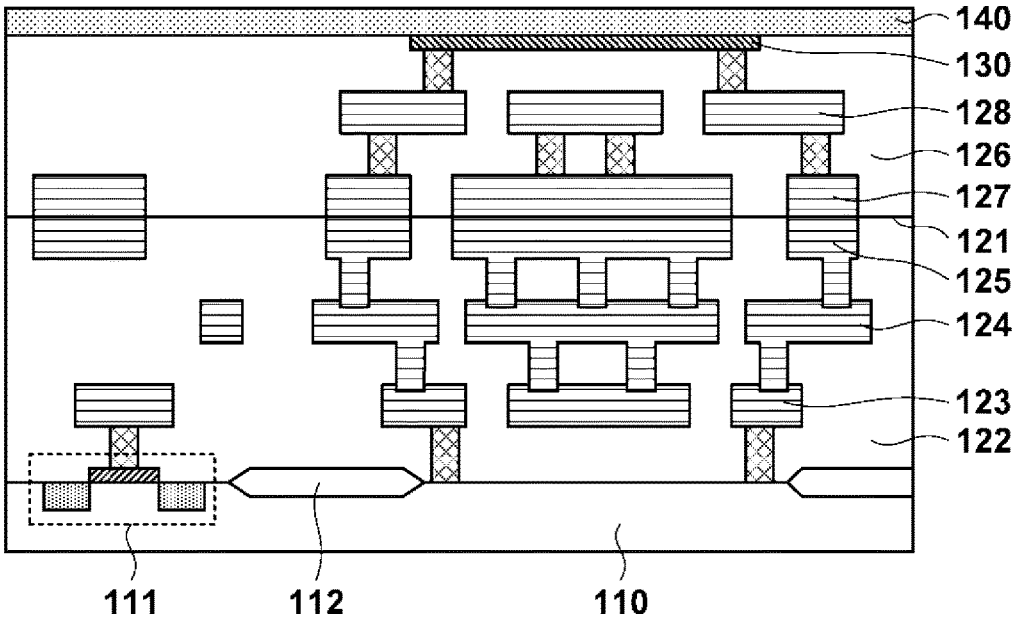

[Fig. 5A]
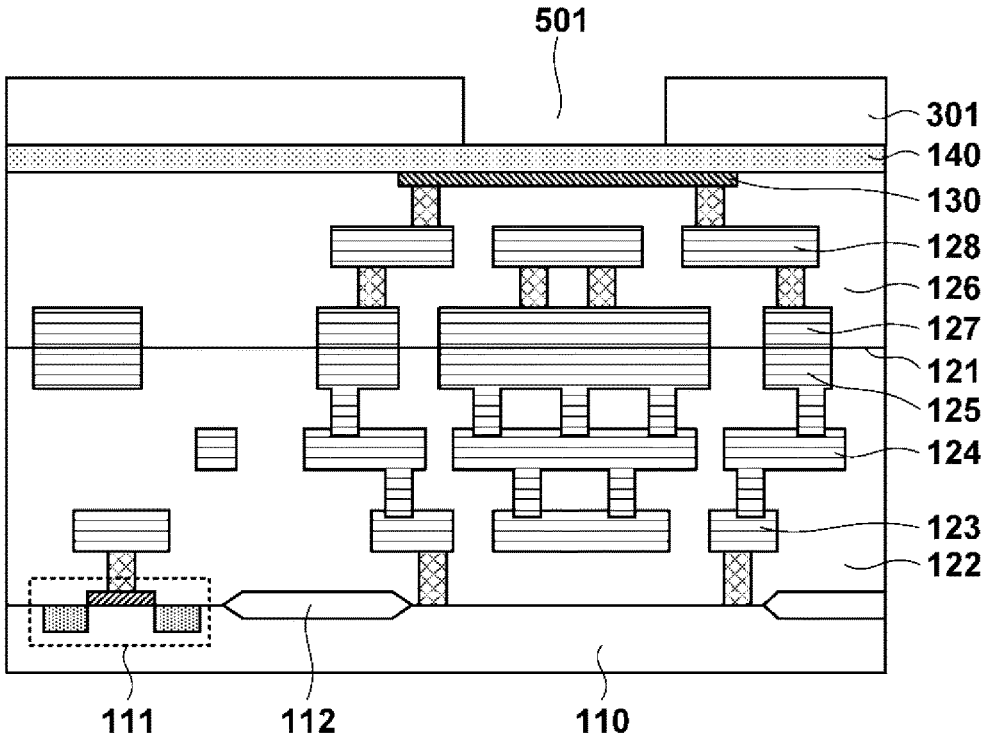
[Fig. 5B]
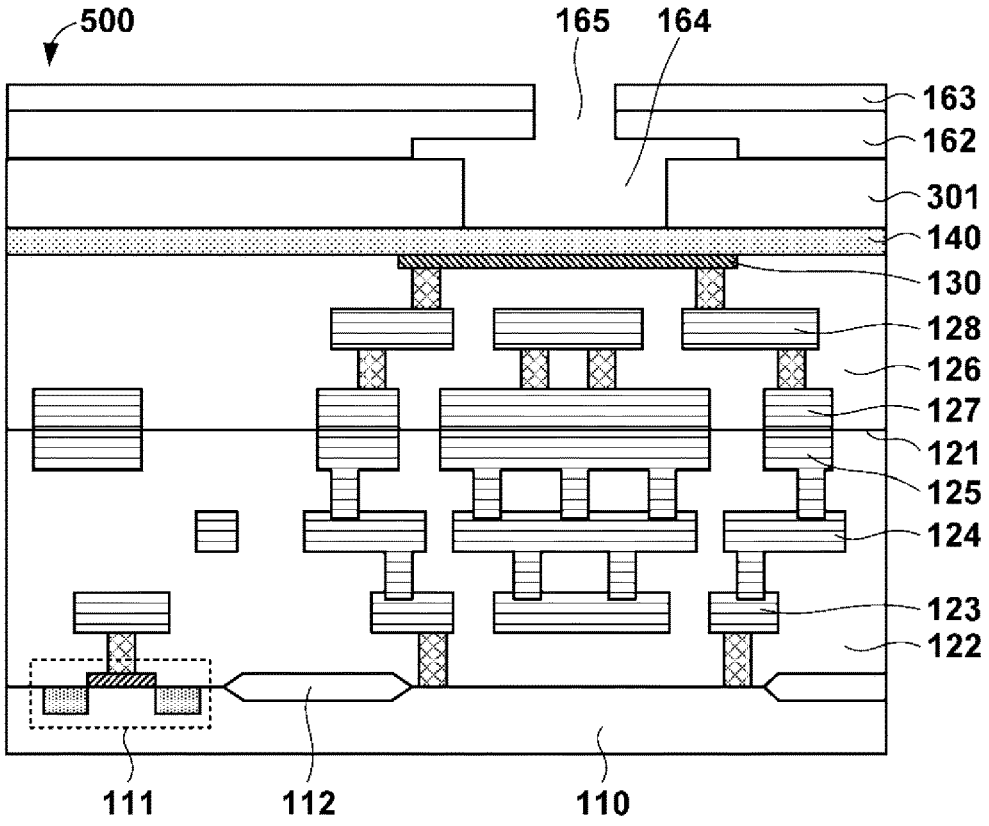

[Fig. 6]
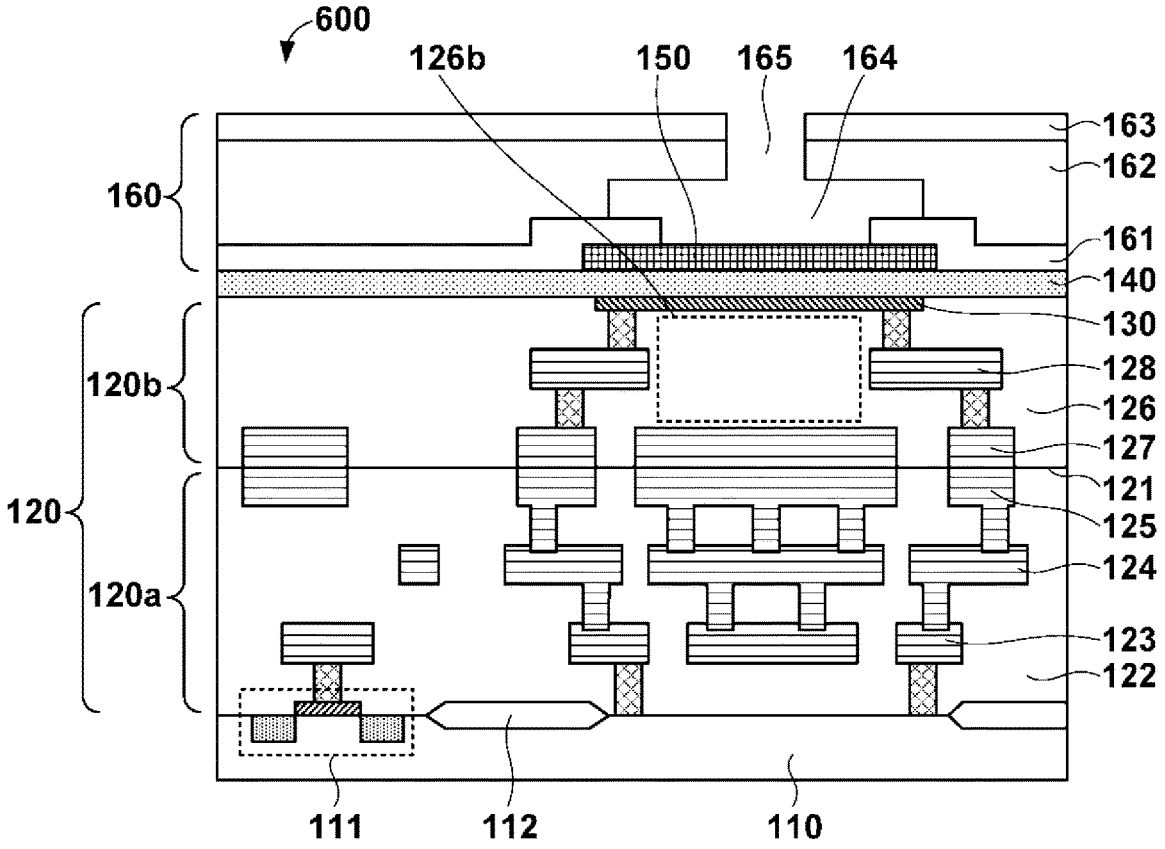

[Fig. 7A]
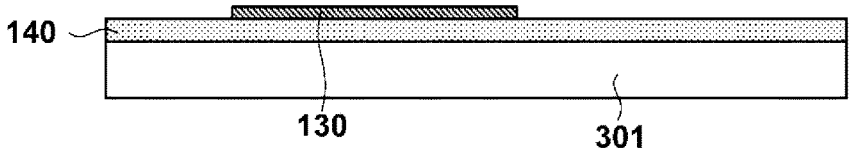
[Fig. 7B]
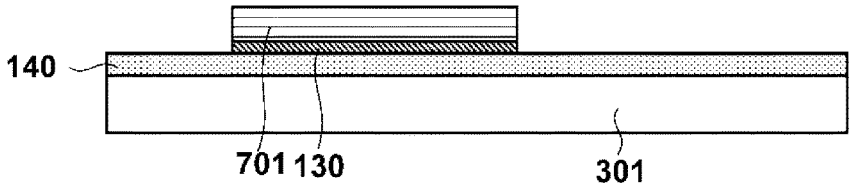
[Fig. 7C]
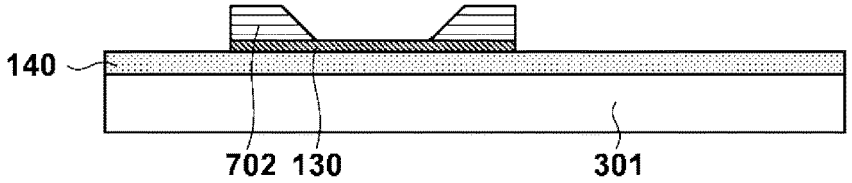
[Fig. 7D]
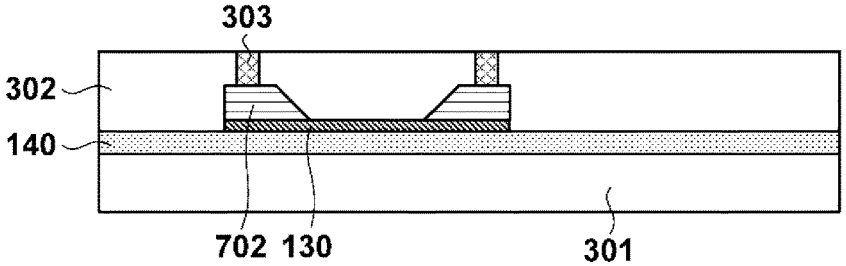
[Fig. 7E]
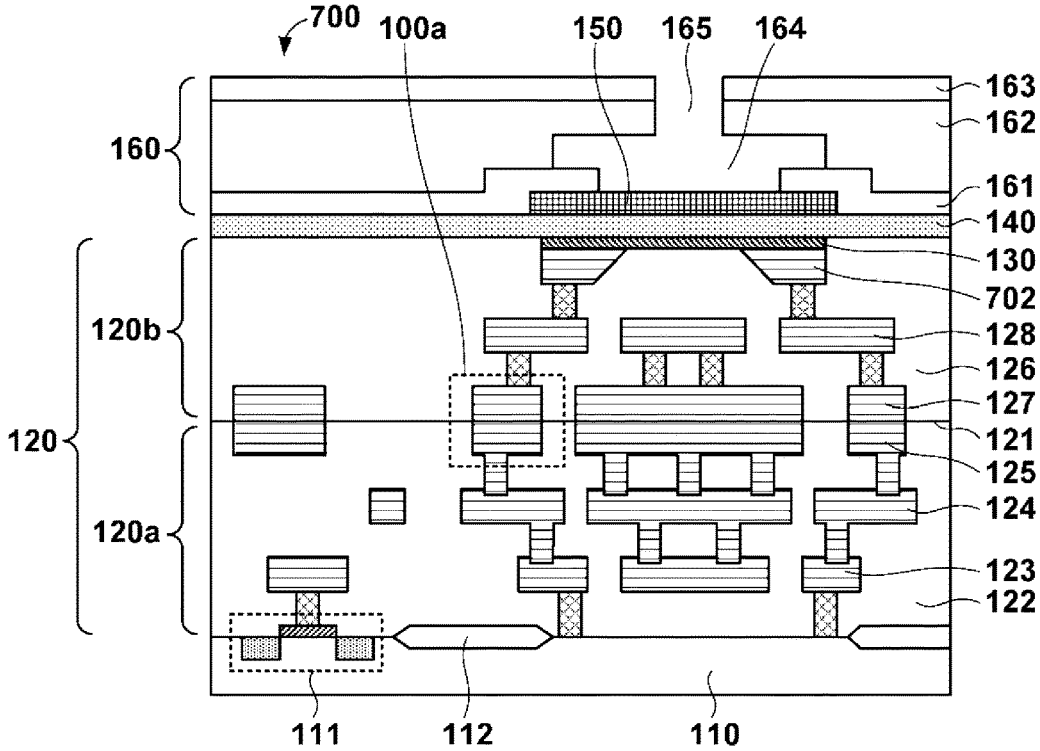

[Fig. 8A]
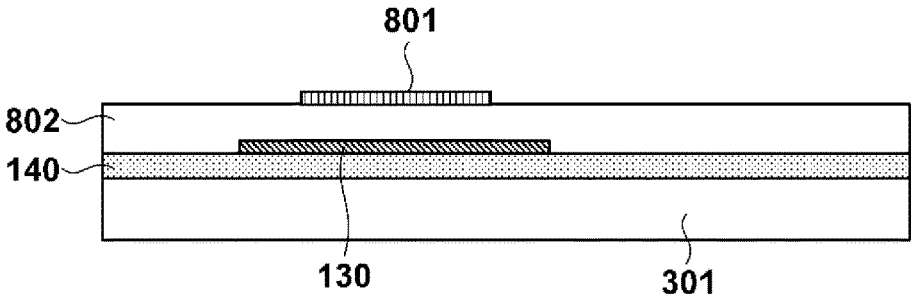
[Fig. 8B]
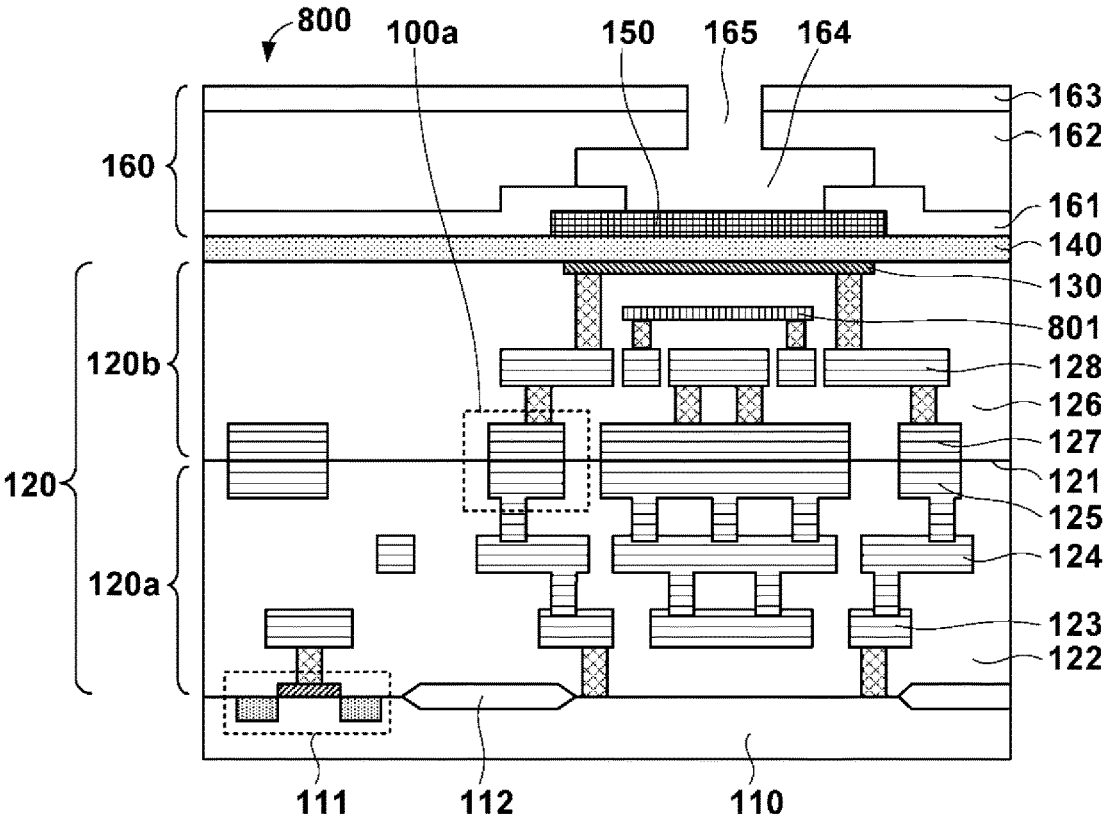

[Fig. 9A]
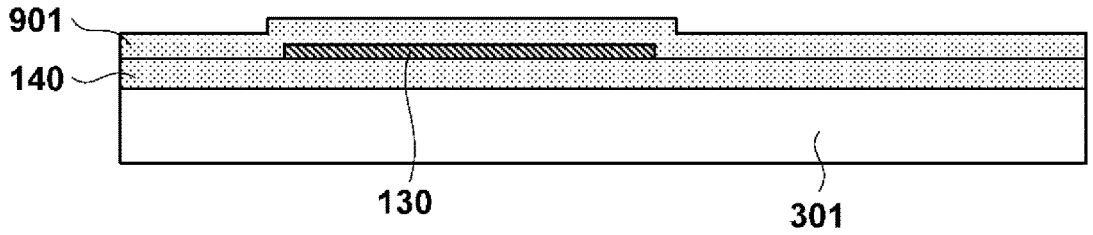
[Fig. 9B]
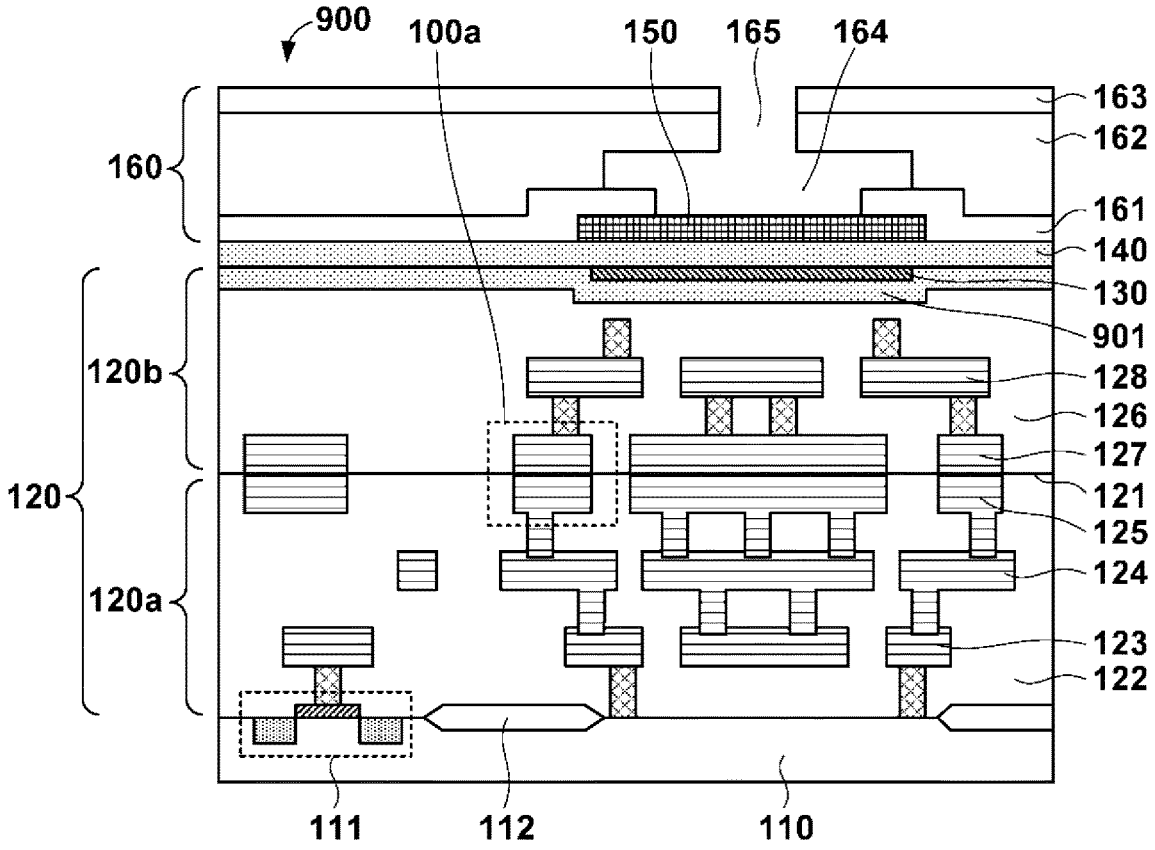

[Fig. 10A]
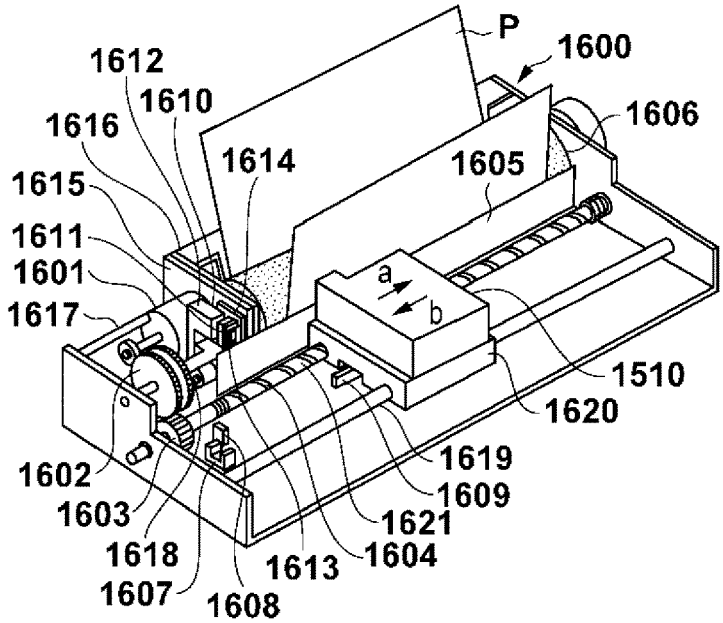
[Fig. 10B]
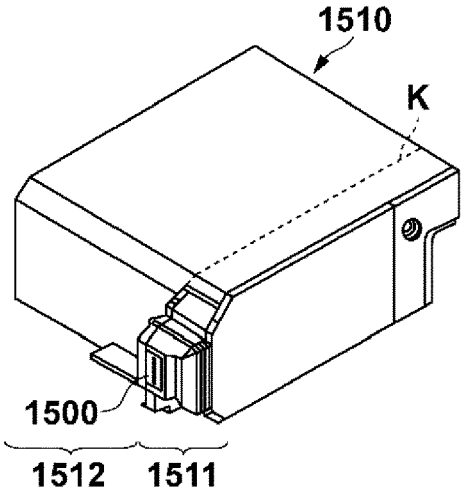
[Fig. 10C]
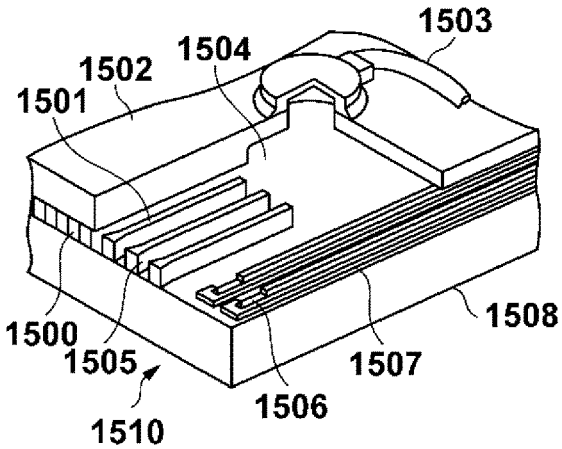

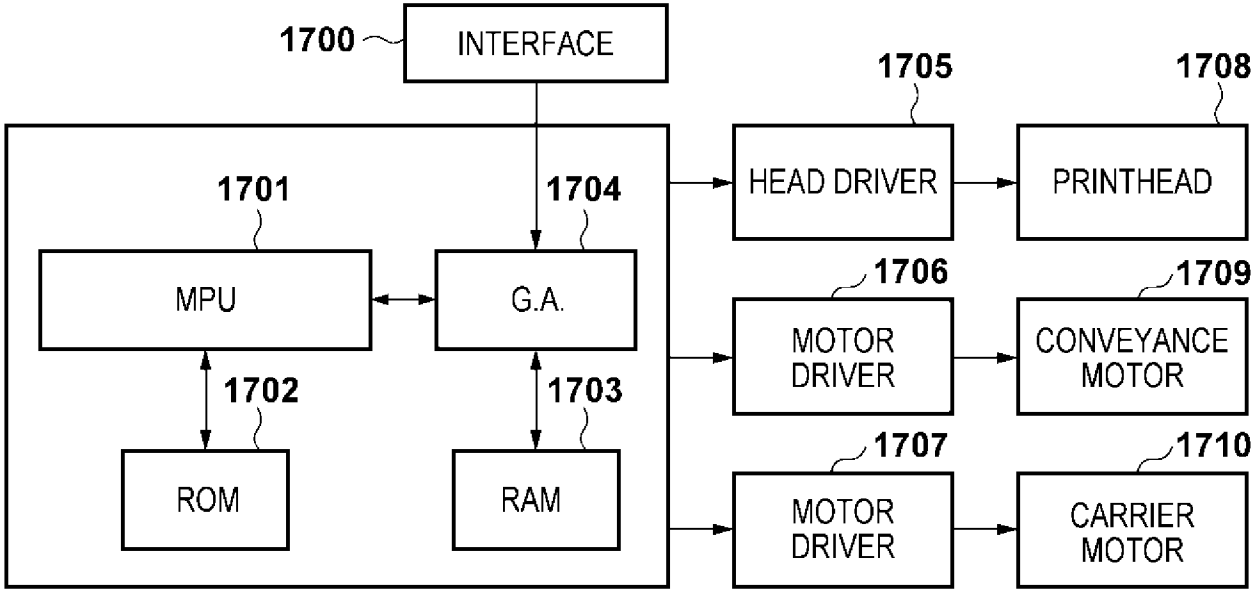
[Fig. 10D]

[Fig. 11A]
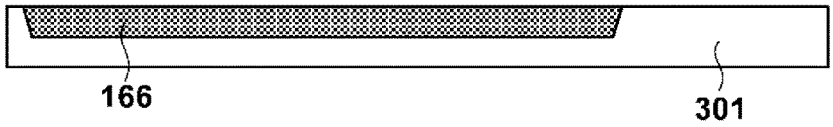
[Fig. 11B]
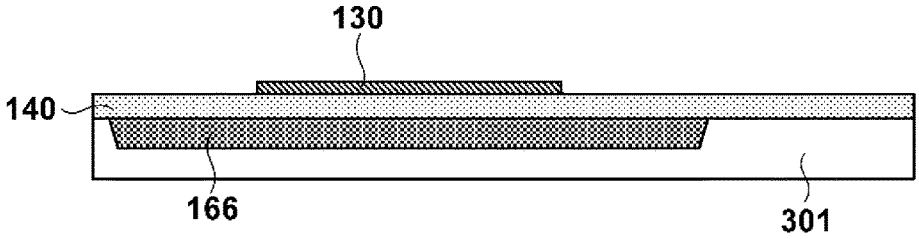
[Fig. 11C]
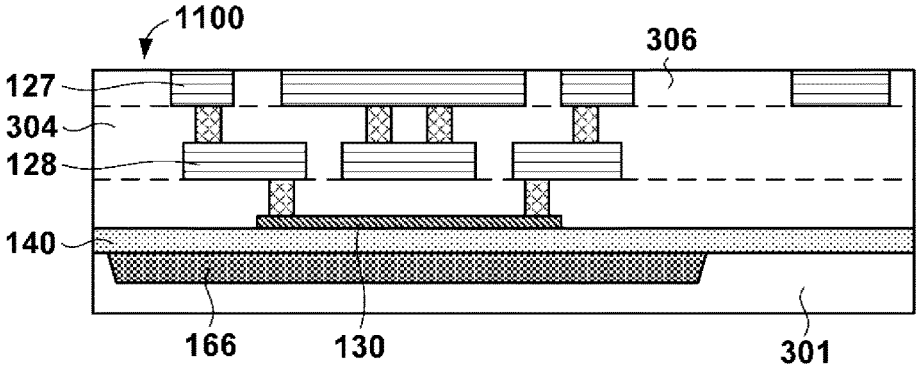
[Fig. 11D]
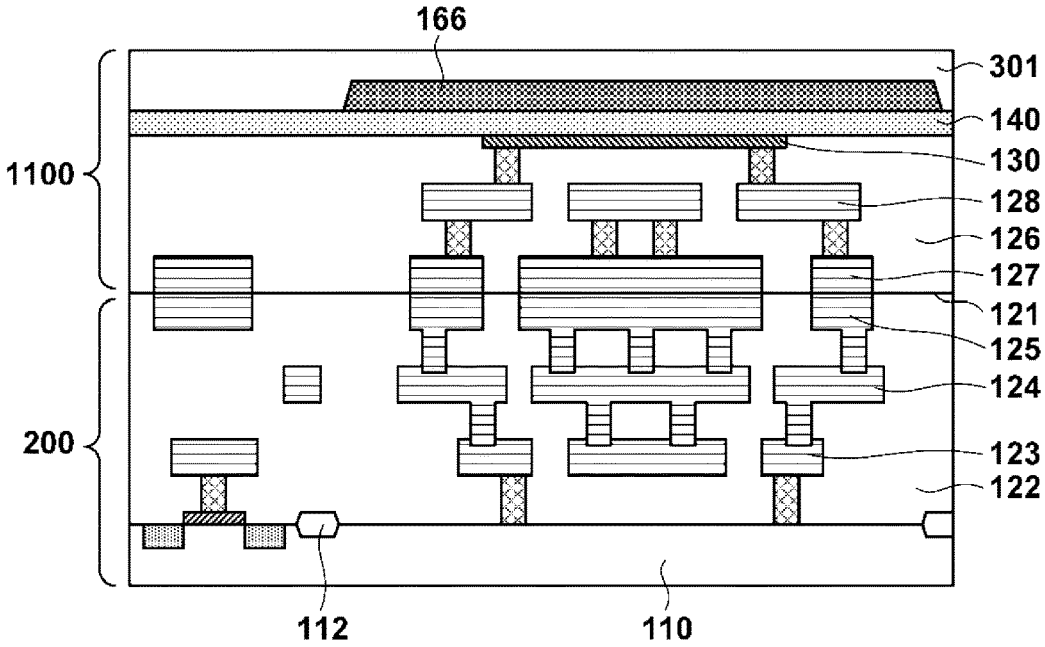

[Fig. 12]
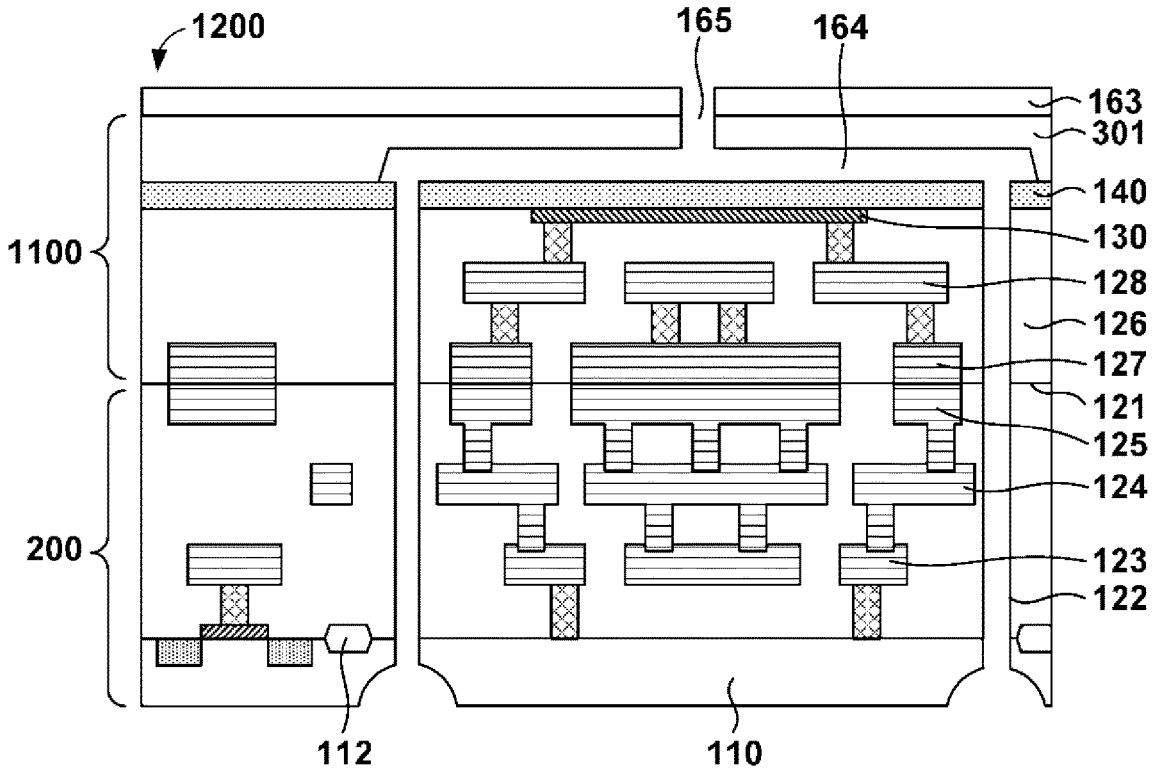

[Fig. 13A]
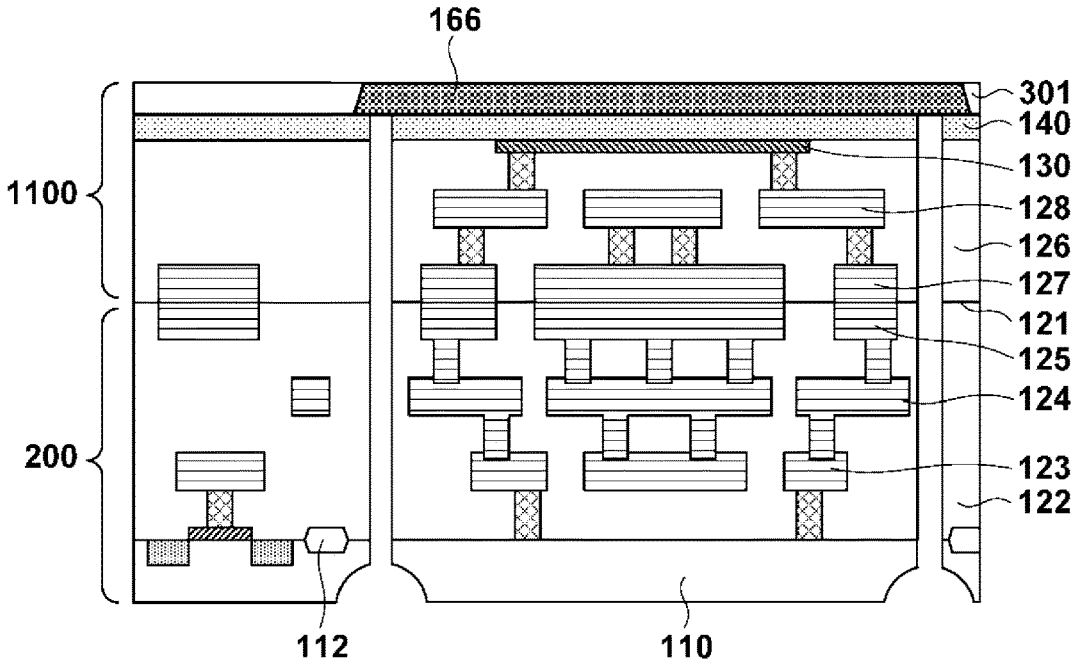
[Fig. 13B]
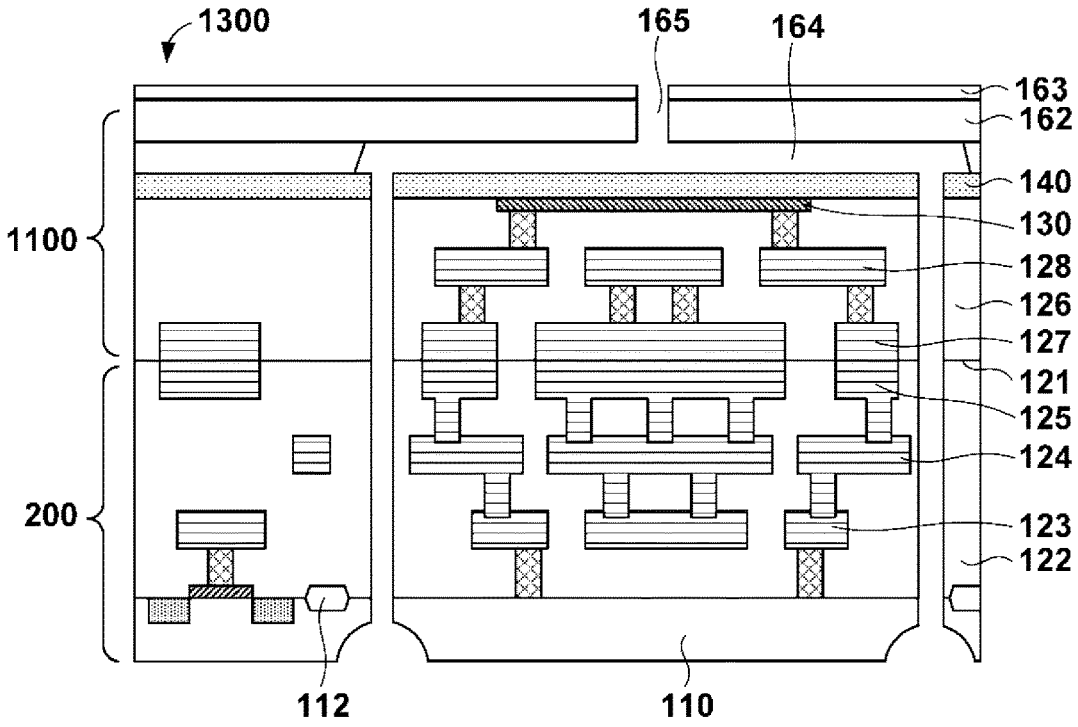

LIQUID DISCHARGE HEAD SUBSTRATE, METHOD OF MANUFACTURING THE SAME, LIQUID DISCHARGE HEAD, AND LIQUID DISCHARGE APPARATUS

The present application is a continuation of U.S. patent application Ser. No. 16/342,097 filed Apr. 15, 2019, which is a national phase entry of PCT/JP2018/002188 filed Jan. 25, 2018, which claims benefit of Japanese Patent Applications Nos. 2017-028421 and 2017-219330, filed on Feb. 17, 2017, and Nov. 14, 2017, respectively, the entire contents of each of which are incorporated herein by reference.

TECHNICAL FIELD

The present invention relates to a liquid discharge head substrate, a method of manufacturing the same, a liquid discharge head, and a liquid discharge apparatus.

BACKGROUND ART

A liquid discharge head is widely used as a part of a printing apparatus that prints information such as characters or images on a sheet-shaped printing medium such as a sheet or a film. Japanese Patent Laid-Open No. 2016-137705 describes a method of forming a wiring structure on a semiconductor substrate where a circuit element is formed, and forming a heat generation element on the wiring structure, thereby forming a liquid discharge head substrate. The wiring structure includes a plurality of wiring layers, and its upper surface is planarized every time each wiring layer is formed.

CITATION LIST

Patent Literature

PTL 1: Japanese Patent Laid-Open No. 2016-137705

SUMMARY OF INVENTION

In a liquid discharge head substrate, the liquid discharge characteristic of a heat generation element is determined by the thickness of an insulating layer between the heat generation element and a conductive member immediately below it. Heat dissipation from the heat generation element to the conductive member decreases if the thickness of this insulating layer is larger than a design value, making a liquid discharge amount larger than the design value. On the other hand, heat dissipation from the heat generation element to the conductive member increases if the thickness of this insulating layer is smaller than the design value, making the liquid discharge amount smaller than the design value. In a manufacturing method described in Japanese Patent Laid-Open No. 2016-137705, the heat generation element is formed on the uppermost wiring layer. An upper surface is planarized each time a wiring layer is formed, and thus an upper wiring layer has lower flatness. It is therefore difficult to form the liquid discharge head substrate such that the thickness of the insulating layer between the heat generation element and the conductive member immediately below it conforms to the design value over an entire wafer, making it impossible to improve performance of the liquid discharge head substrate sufficiently. An aspect of the present invention provides a technique for improving the performance of the liquid discharge head substrate.

According to some embodiments, a method of manufacturing a liquid discharge head substrate is provided. The method includes forming a first substrate that includes a semiconductor element and a first wiring structure; forming a second substrate that includes a liquid discharge element and a second wiring structure; and bonding the first wiring structure and the second wiring structure such that the semiconductor element and the liquid discharge element are electrically connected to each other after the forming the first substrate and the second substrate.

Further features of the present invention will become apparent from the following description of exemplary embodiments (with reference to the attached drawings).

BRIEF DESCRIPTION OF DRAWINGS

FIG. 1A is a view for explaining an example of the arrangement of a liquid discharge head substrate according to the first embodiment.

FIG. 1B is a view for explaining an example of the arrangement of a liquid discharge head substrate according to the first embodiment.

FIG. 2A is a view for explaining an example of a method of manufacturing the liquid discharge head substrate according to the first embodiment.

FIG. 2B is a view for explaining an example of a method of manufacturing the liquid discharge head substrate according to the first embodiment.

FIG. 2C is a view for explaining an example of a method of manufacturing the liquid discharge head substrate according to the first embodiment.

FIG. 2D is a view for explaining an example of a method of manufacturing the liquid discharge head substrate according to the first embodiment.

FIG. 2E is a view for explaining an example of a method of manufacturing the liquid discharge head substrate according to the first embodiment.

FIG. 3A is a view for explaining an example of the method of manufacturing the liquid discharge head substrate according to the first embodiment.

FIG. 3B is a view for explaining an example of the method of manufacturing the liquid discharge head substrate according to the first embodiment.

FIG. 3C is a view for explaining an example of the method of manufacturing the liquid discharge head substrate according to the first embodiment.

FIG. 3D is a view for explaining an example of the method of manufacturing the liquid discharge head substrate according to the first embodiment.

FIG. 3E is a view for explaining an example of the method of manufacturing the liquid discharge head substrate according to the first embodiment.

FIG. 4A is a view for explaining an example of the method of manufacturing the liquid discharge head substrate according to the first embodiment.

FIG. 4B is a view for explaining an example of the method of manufacturing the liquid discharge head substrate according to the first embodiment.

FIG. 5A is a view for explaining a liquid discharge head substrate according to the second embodiment.

FIG. 5B is a view for explaining a liquid discharge head substrate according to the second embodiment.

FIG. 6 is a view for explaining a liquid discharge head substrate according to the third embodiment.

FIG. 7A is a view for explaining a liquid discharge head substrate according to the fourth embodiment.

FIG. 7B is a view for explaining a liquid discharge head substrate according to the fourth embodiment.

FIG. 7C is a view for explaining a liquid discharge head substrate according to the fourth embodiment.

FIG. 7D is a view for explaining a liquid discharge head substrate according to the fourth embodiment.

FIG. 7E is a view for explaining a liquid discharge head substrate according to the fourth embodiment.

FIG. 8A is a view for explaining a liquid discharge head substrate according to the fifth embodiment.

FIG. 8B is a view for explaining a liquid discharge head substrate according to the fifth embodiment.

FIG. 9A is a view for explaining a liquid discharge head substrate according to the sixth embodiment.

FIG. 9B is a view for explaining a liquid discharge head substrate according to the sixth embodiment.

FIG. 10A is a view for explaining still another embodiment.

FIG. 10B is a view for explaining still another embodiment.

FIG. 10C is a view for explaining still another embodiment.

FIG. 10D is a view for explaining still another embodiment.

FIG. 11A is a view for explaining a liquid discharge head substrate according to the seventh embodiment.

FIG. 11B is a view for explaining a liquid discharge head substrate according to the seventh embodiment.

FIG. 11C is a view for explaining a liquid discharge head substrate according to the seventh embodiment.

FIG. 11D is a view for explaining a liquid discharge head substrate according to the seventh embodiment.

FIG. 12 is a view for explaining the liquid discharge head substrate according to the seventh embodiment.

FIG. 13A is a view for explaining a liquid discharge head substrate according to the eighth embodiment.

FIG. 13B is a view for explaining a liquid discharge head substrate according to the eighth embodiment.

DESCRIPTION OF EMBODIMENTS

Embodiments of the present invention will now be described with reference to the accompanying drawings. The same reference numerals denote the same elements throughout various embodiments, and a repetitive description thereof will be omitted. The embodiments can appropriately be changed or combined. A liquid discharge head substrate will simply be referred to as a discharge substrate hereinafter. The discharge substrate is used for a liquid discharge apparatus such as a copying machine, a facsimile apparatus, or a word processor. In the embodiments below, a heat generation element is treated as an example of a liquid discharge element of a discharge substrate. The liquid discharge element may be an element such as a piezoelectric element or the like capable of applying energy to a liquid.

First Embodiment

An example of the arrangement of a discharge substrate 100 according to the first embodiment will be described with reference to FIGS. 1A and 1B. FIG. 1A is a sectional view that focuses on a part of the discharge substrate 100. FIG. 1B is an enlarged view of a region 100*a* in FIG. 1A.

The discharge substrate 100 includes a base 110, a wiring structure 120, a heat generation element 130, a protective film 140, an anti-cavitation film 150, and a nozzle structure 160. The base 110 is, for example, a semiconductor layer of silicon or the like. A semiconductor element 111 such as a transistor and an element isolation region 112 such as LOCOS or STI are formed in the base 110.

The wiring structure 120 is positioned on the base 110. Using a flat bonding surface 121 as a boundary, the wiring structure 120 is divided into a wiring structure 120*a* below the bonding surface 121 and a wiring structure 120*b* above the bonding surface 121. The wiring structure 120*a* includes an insulating member 122 and conductive members 123 to 125 of a plurality of layers inside the insulating member 122. The conductive members 123 to 125 of the plurality of layers are stacked. The conductive member 123 of a layer closest to the base 110 is connected, by plugs, to the semiconductor element 111 and the like formed in the base 110. The conductive members positioned in adjacent layers of the plurality of layers are connected to each other by plugs.

The wiring structure 120*b* includes an insulating member 126, and conductive members 127 and 128 of a plurality of layers inside the insulating member 126. The conductive members 127 and 128 of the plurality of layers are stacked. The conductive member 128 of a layer farthest from the base 110 is connected to the heat generation element 130 by a plug. The conductive member 127 and the conductive member 128 are connected to each other by a plug.

Each of the conductive members 123 to 125, 127, and 128 may partially include a dummy pattern. The dummy pattern is a conductive pattern which is not electrically connected to the semiconductor element 111 and does not contribute to signal transfer or power supply. Each of the conductive members 123 to 125, 127, and 128 may be formed by a barrier metal layer and a metal layer. The barrier metal layer is formed by, for example, tantalum, a tantalum compound, titanium, or a titanium compound and suppresses diffusion or interaction of a material included in the metal layer. The metal layer is formed by copper or an aluminum compound and is lower than the barrier metal layer in resistance.

As shown in FIG. 1B, the conductive member 125 is formed by a metal layer 125*a* and a barrier metal layer 125*b*. The barrier metal layer 125*b* is arranged between the metal layer 125*a* and the insulating member 122. The conductive member 127 is formed by a metal layer 127*a* and a barrier metal layer 127*b*. The barrier metal layer 127*b* is arranged between the metal layer 127*a* and the insulating member 126. The metal layer 125*a* and the metal layer 127*a*, the barrier metal layer 125*a* and the barrier metal layer 125*b*, and the insulating member 122 and the insulating member 126 are bonded to each other on the bonding surface 121. Since the bonding surface 121 is flat, the upper surface of the conductive member 125 and the upper surface of the insulating member 122 are flush with each other, and the lower surface of the conductive member 127 and the lower surface of the insulating member 126 are flush with each other. As will be described later, the discharge substrate 100 is manufactured by bonding two substrates. Consequently, a part of the metal layer 125*a* may be bonded to a part of the barrier metal layer 127*b*, or a part of the metal layer 127*a* may be bonded to a part of the barrier metal layer 125*b* depending on an alignment accuracy or processing accuracy at the time of bonding. The thickness of the barrier metal layer 125*b* may be adjusted so as not to bond the metal layer 125*a* and the insulating member 126 to each other even if the alignment accuracy or the processing accuracy varies. The same also applies to bonding between the metal layer 127*a* and the insulating member 122.

The heat generation element 130 is positioned in the upper part of the wiring structure 120. The side surfaces of the heat generation element 130 contact the insulating member 126. The upper surface of the heat generation element 130 is on the same plane as the upper surface of the wiring structure 120, that is, the upper surface of the insulating member 126. The semiconductor element 111 and the heat generation element 130 are electrically connected to each other by the wiring structure 120 (more specifically, by the conductive members included in the wiring structure 120). The heat generation element 130 is formed by, for example, tantalum or a tantalum compound. Instead of this, the heat generation element 130 may be formed by polysilicon or tungsten silicide.

The conductive member 128 of a layer closest to the heat generation element 130 out of the conductive members 123 to 125, 127, and 128 of the plurality of layers includes a conductive portion immediately below the heat generation element 130. The liquid discharge characteristic of the heat generation element 130 is determined by the thickness of a region 126*a* of the insulating member 126 between this conductive portion and the heat generation element 130. Heat dissipation from the heat generation element 130 to the conductive members decreases if the thickness of this insulating layer is larger than a design value, making a liquid discharge amount larger than the design value. On the other hand, heat dissipation from the heat generation element 130 to the conductive members increases if the thickness of this insulating layer is smaller than the design value, making the liquid discharge amount smaller than the design value. The region 126*a* can also be referred to as a heat accumulation region.

The protective film 140 is positioned on the wiring structure 120 and the heat generation element 130. The protective film 140 covers at least the upper surface of the heat generation element 130 and also covers the upper surface of the wiring structure 120 in this embodiment. The protective film 140 is made of, for example, SiO, SiON, SiOC, SiC, or SiN and protects the heat generation element 130 from liquid erosion. In this embodiment, the both surfaces of the protective film 140, that is, the surface on the side of the heat generation element 130 and the surface opposite to it are flat. It is therefore possible to sufficiently ensure the coverage of the heat generation element 130 even if the protective film 140 is thin, as compared with a case in which the protective film has a step. Energy transfer efficiency to a liquid improves by thinning the protective film 140, making it possible to implement both a reduction in power consumption and an improvement in image quality by stabilizing foaming.

The anti-cavitation film 150 is positioned on the protective film 140. The anti-cavitation film 150 covers the heat generation element 130 across the protective film 140. The anti-cavitation film 150 is formed by, for example, tantalum, and protects the heat generation element 130 and the protective film 140 from a physical shock at the time of liquid discharge.

The nozzle structure 160 is positioned on the protective film 140 and the anti-cavitation film 150. The nozzle structure 160 includes an adherence layer 161, a nozzle member 162, and a water-repellent material 163. A channel 164 and an orifice 165 of a discharged liquid are formed in the nozzle structure 160.

Then, a method of manufacturing the discharge substrate 100 will be described with reference to FIGS. 2A to 4B. First, as shown in FIG. 2E, a substrate 200 that includes the semiconductor element 111 is formed. A method of forming the substrate 200 will be described below in detail. As shown in FIG. 2A, the semiconductor element 111 and the element isolation region 112 are formed in the base 110 of a semiconductor material. The semiconductor element 111 may be, for example, a switch element such as a transistor. The element isolation region 112 may be formed by the LOCOS method or the STI method.

Subsequently, a structure shown in FIG. 2B is formed. More specifically, an insulating layer 201 is formed on the base 110, holes are formed in the insulating layer 201, and a plug 202 is formed in each hole. The plug 202 is formed by, for example, forming a metal film on the insulating layer 201 and removing a portion other than a portion of this metal film that enters the hole of the insulating layer 201 by etchback or CMP. The insulating layer 201 is formed by, for example, SiO, SiN, SiC, SiON, SiOC, or SiCN. The upper surface of the insulating layer 201 may be planarized.

Subsequently, a structure shown in FIG. 2C is formed. More specifically, an insulating layer 203 is formed on the insulating layer 201, and openings are formed in the insulating layer 203. A barrier metal layer is formed on the insulating layer 203, and a metal layer is formed thereon. The conductive member 123 is formed by removing a portion other than portions of the barrier metal layer and metal film that enter the openings of the insulating layer 203 by etchback or CMP. The barrier metal layer is formed by, for example, tantalum, a tantalum compound, titanium, or a titanium compound. The conductive member 123 is formed by, for example, copper, aluminum, or tungsten. The upper surfaces of the insulating layer 203 and the conductive member 123 may be planarized.

Subsequently, a structure shown in FIG. 2D is formed. More specifically, an insulating layer 204 is formed on the insulating layer 203, and openings are formed in the insulating layer 204. The conductive member 124 is formed in the same manner as the conductive member 123. The upper surfaces of the insulating layer 204 and the conductive member 124 may be planarized.

Subsequently, a structure shown in FIG. 2E is formed. More specifically, an insulating layer 205 is formed on the insulating layer 204, and openings are formed in the insulating layer 205. The conductive member 125 is formed in the same manner as the conductive member 124. The upper surfaces of the insulating layer 205 and the conductive member 125 may be planarized.

The substrate 200 is formed as described above. In this embodiment, the substrate 200 includes the conductive members 123 to 125 of three layers. However, the number of layers of the conductive members is not limited to this, and it may be one, two, or four or more. In addition, each conductive member may have a single damascene structure or a dual damascene structure. The wiring structure of the substrate 200 becomes the wiring structure 120*a* of the discharge substrate 100. The insulating member 122 of the wiring structure 120*a* is formed by the insulating layers 201, 203, 204, and 205. The upper surface of the substrate 200 (a surface on the side opposite to the base 110) is flat.

The upper limit value of a temperature at which metal materials of the plug 202, the conductive members 123, 124, and 125, and the like included in the wiring structure 120*a* are not influenced by melting or the like will be referred to as a critical temperature. The critical temperature can change depending on the type of metal material and may be, for example, 400° C., 450° C., or 500° C. The substrate 200 is formed such that the highest temperature in thermal histories received by the metal materials included in the wiring structure 120*a* during the manufacture of the substrate 200 becomes lower than the critical temperature (for example, lower than 400° C., lower than 450° C., or lower than 500° C.).

The thermal history about a certain portion of a semiconductor device means a temperature transition of the portion in a manufacturing step of the semiconductor device including a time when the portion is formed. For example, a certain member is formed at a substrate temperature of 400° C., and then a substrate including the portion is processed at a substrate temperature of 350° C. In this case, the portion has a thermal history of 400° C. and 350° C.

Then, as shown in FIG. 3E, a substrate 300 that includes the heat generation element 130 is formed. Either the substrate 200 or the substrate 300 may be formed first. A method of forming the substrate 300 will be described below in detail. As shown in FIG. 3A, the protective film 140 is formed on a base 301, and the heat generation element 130 is formed on the protective film 140. The base 301 may be formed by a semiconductor material such as silicon or an insulator material such as glass.

The protective film 140 is formed by, for example, a silicon insulator of silicon dioxide, silicon nitride, silicon carbide, or the like. The protective film 140 may be annealed at a high temperature in order to improve the humidity resistance of the protective film 140. In general, the insulator improves in humidity resistance as a temperature used for annealing is high. A wiring structure has not been formed yet at this point, and thus it is possible to anneal the protective film 140 at a temperature equal to or higher than the critical temperature (for example, 400° C. or higher, 450° C. or higher, or 500° C. or higher, and more specifically, 650° C.). Before the heat generation element 130 is formed, the upper surface of the protective film 140 may be planarized by the CMP method or the like. Instead of annealing, plasma processing may be performed on the heat generation element 130. In this embodiment, the humidity resistance of the protective film 140 is high, increasing the life of the discharge substrate 100.

The heat generation element 130 is formed by, for example, tantalum or a tantalum compound. The heat generation element 130 may be annealed at the temperature equal to or higher than the critical temperature (for example, 400° C. or higher, 450° C. or higher, or 500° C. or higher, and more specifically, 650° C.). This makes it possible to improve the resistance value of the heat generation element 130 and save power of the discharge substrate 100. The heat generation element 130 crystalizes by annealing the heat generation element 130 at the temperature equal to or higher than the critical temperature, making it possible to stabilize the initial characteristic of the heat generation element 130. The heat generation element 130 may be formed by polysilicon higher than tantalum or the tantalum compound in resistance. A high-temperature process is needed in order to form the heat generation element 130 by polysilicon. It is possible, however, to form the heat generation element 130 at the temperature equal to or higher than the critical temperature as described above. In addition, it is possible to select a material that cannot be used at a temperature lower than the critical temperature as a material of the heat generation element 130.

A wiring conductive member may be formed in the same layer as the heat generation element 130. In this case, the heat generation element 130 may not be annealed at the temperature equal to or higher than the critical temperature. The protective film 140 and the heat generation element 130 may be annealed separately or simultaneously. At least one of the protective film 140 and the heat generation element 130 is annealed at the temperature equal to or higher than the critical temperature.

Subsequently, a structure shown in FIG. 3B is formed. More specifically, an insulating layer 302 is formed on the protective film 140 and the heat generation element 130, holes are formed in the insulating layer 302, and a plug 303 is formed in each hole. The plug 303 is formed by, for example, forming a metal film of copper or tungsten on the insulating layer 302 and removing a portion other than a portion of this metal film that enters the hole of the insulating layer 302 by etchback or CMP. The insulating layer 302 is formed by, for example, SiO, SiN, SiC, SiON, SiOC, or SiCN. The thickness of the insulating layer 302 may be adjusted by further planarizing the upper surface of the insulating layer 302.

Subsequently, as shown in FIG. 3C, the conductive member 128 is formed on the insulating layer 302. The conductive member 128 is formed by copper or aluminum. Subsequently, as shown in FIG. 3D, an insulating layer 304 is formed on the insulating layer 302 and the conductive member 128, and a plug 305 is formed in the insulating layer 304. The plug 305 includes a barrier metal layer and a metal layer. The barrier metal layer is formed by, for example, titanium, or a titanium compound. The metal layer is, for example, a tungsten layer.

Subsequently, as shown in FIG. 3E, an insulating layer 306 and the conductive member 127 are formed on the insulating layer 304. The conductive member 127 includes a barrier metal layer and a metal layer. The barrier metal layer is formed by, for example, tantalum, a tantalum compound, titanium, or a titanium compound. The metal layer is formed by, for example, copper or aluminum.

The substrate 300 is formed as described above. In this embodiment, the substrate 300 includes the conductive members of two layers. However, the number of layers of the conductive members is not limited to this, and it may be one, or three or more. In addition, each conductive member may have a single damascene structure or a dual damascene structure. The wiring structure of the substrate 300 becomes the wiring structure 120*b* of the discharge substrate 100. The insulating member 126 of the wiring structure 120*b* is formed by the insulating layers 302, 304, and 306. The upper surface of the substrate 300 (a surface on the side opposite to the base 301) is flat.

The substrate 300 is formed such that the highest temperature in a thermal history received by the heat generation element 130 or the protective film 140 becomes equal to or higher than the critical temperature, and the highest temperature in thermal histories received by metal materials included in the wiring structure 120*b* during the manufacture of the substrate 300 becomes lower than the critical temperature. The metal materials included in the wiring structure 120*b* are, for example, the plugs 303 and 305, and the conductive members 127 and 128.

In a manufacturing method of forming a wiring structure on a base that includes a semiconductor element and forming a heat generation element thereon, the heat generation element is formed on the uppermost wiring layer. An upper surface is planarized each time a wiring layer is formed, and thus an upper wiring layer has lower flatness. In contrast, in the above-described method of manufacturing the substrate 300, the insulating layer 302 in which the insulating member 126 is closest to the protective film 140 and the heat generation element 130 is formed prior to other insulating layers of the wiring structure 120, and thus the flatness of this insulating layer 302 is high. As a result, it becomes easier to form the substrate 300 such that the thickness of the region 126*a* in the insulating layer 302 conforms to a design value over an entire wafer, improving discharge performance of the heat generation element 130.

Then, as shown in FIG. 4A, the wiring structure of the substrate 200 and the wiring structure of the substrate 300 are bonded to each other such that the semiconductor element 111 and the heat generation element 130 are electrically connected to each other. More specifically, the conductive member 125 and the conductive member 127 are bonded to each other, and the insulating member 122 and the insulating member 126 are bonded to each other. The substrate 200 and the substrate 300 may be bonded to each other by heating them in an overlaid state or by using a catalyst such as argon.

Subsequently, the entire base 301 is removed as shown in FIG. 4B. Subsequently, the discharge substrate 100 is manufactured by forming the anti-cavitation film 150 and the nozzle structure 160. Steps in FIGS. 4A and 4B may be performed at the temperature lower than the critical temperature. Therefore, the highest temperature of the thermal history received by the heat generation element 130 or the protective film 140 during the manufacture of the discharge substrate 100 is higher than the highest temperature in thermal histories received by the conductive members included in the wiring structure 120 during the manufacture of the discharge substrate 100.

The respective steps of the above-described manufacturing method may be performed by a single manufacturer or a plurality of manufacturers. The substrate 200 and the substrate 300 may be bonded to each other after, for example, one manufacturer forms the substrate 200 and the substrate 300, and another manufacturer prepares the substrate 200 and the substrate 300 by purchasing them. Instead of this, one manufacturer may form the substrate 200 and the substrate 300, and then this manufacturer may instruct another manufacturer to bond them.

Second Embodiment

An example of the arrangement of a discharge substrate 500 and a manufacturing method thereof according to the second embodiment will be described with reference to FIGS. 5A and 5B. A description of the same part as in the first embodiment will be omitted. The method of manufacturing the discharge substrate 500 may be the same as a method of manufacturing a discharge substrate 100 until steps shown in FIG. 4A. Subsequently, as shown in FIG. 5A, a portion of a base 301 that overlaps a heat generation element 130 is removed instead of removing the entire base 301. Consequently, an opening 501 is formed in a remaining portion of the base 301. This opening 501 is positioned above the heat generation element 130.

Subsequently, as shown in FIG. 5B, a nozzle member 162 and a water-repellent material 163 are formed on the base 301. An orifice 165 is formed by the nozzle member 162 and the water-repellent material 163. The opening 501 of the base 301 forms a part of a channel 164 of a discharged liquid. The discharge substrate 500 is thus manufactured.

The discharge substrate 500 shown in FIG. 5B does not include an anti-cavitation film. However, an anti-cavitation film that covers the heat generation element 130 across a protective film 140 may be formed after a part of the base 301 is removed. An adherence layer for improving adhesion may further be formed between the base 301 and the nozzle member 162. According to this embodiment, the part of the base 301 can also be used as a nozzle structure.

Third Embodiment

An example of the arrangement of a discharge substrate 600 according to the third embodiment will be described with reference to FIG. 6. A description of the same part as in the first embodiment will be omitted. The discharge substrate 600 is different from a discharge substrate 100 in shape of a conductive member 128. In the discharge substrate 600, the conductive member 128 of a layer closest to a heat generation element 130 out of conductive members of a plurality of layers does not include a conductive portion immediately below the heat generation element 130, and a conductive member 127 of a second closest layer includes this conductive portion. Therefore, a region 126*b* between the heat generation element 130 and the conductive member 127 becomes a heat accumulation region. According to this embodiment, the heat accumulation region can be wider than in the first embodiment. The size of the heat accumulation region is not limited to this. For example, the heat accumulation region may extend across a bonding surface 121.

Fourth Embodiment

An example of the arrangement of a discharge substrate 700 and a manufacturing method thereof according to the fourth embodiment will be described with reference to FIGS. 7A to 7E. A description of the same part as in the first embodiment will be omitted. A method of manufacturing the discharge substrate 700 is different from a method of manufacturing a discharge substrate 100 in method of manufacturing a substrate 300.

As in the first embodiment, as shown in FIG. 7A, a protective film 140 and a heat generation element 130 are formed on a base 301. When the heat generation element 130 is formed thin, for example, when it is formed with a film thickness of several to several tens of nm, a contact failure may occur between the heat generation element 130 and a plug. In order to avoid such a contact failure, a conductive member is arranged between the heat generation element 130 and a plug 303. This conductive member may be referred to as a connection auxiliary member.

More specifically, as shown in FIG. 7B, a conductive film 701 is formed on the heat generation element 130. The conductive film 701 is formed by, for example, an aluminum alloy. Subsequently, as shown in FIG. 7C, a conductive member 702 is formed by removing a part of the conductive film 701 by dry etching or wet etching. The conductive member 702 contacts only the both sides of the heat generation element 130 and does not contact the central portion of the heat generation element 130. Subsequently, as shown in FIG. 7D, an insulating layer 302 and the plug 303 are formed. Subsequently, the discharge substrate 700 shown in FIG. 7E is manufactured as in steps from FIG. 3C.

Fifth Embodiment

An example of the arrangement of a discharge substrate 800 and a manufacturing method thereof according to the fifth embodiment will be described with reference to FIGS. 8A and 8B. A description of the same part as in the first embodiment will be omitted. A method of manufacturing the discharge substrate 800 is different from a method of manufacturing a discharge substrate 100 in method of manufacturing a substrate 300.

As shown in FIG. 8A, after a protective film 140 and a heat generation element 130 are formed on a base 301 as in the first embodiment, an insulating layer 802 is formed on the protective film 140 and the heat generation element 130, and a temperature sensor 801 is formed thereon. The insulating layer 802 may be formed by the same material as an insulating layer 302. Subsequently, the discharge substrate 800 shown in FIG. 8B is manufactured as in steps from FIG. 3B.

The temperature sensor 801 is used to measure the temperature of the heat generation element 130 and detect whether ink is discharged correctly. The temperature sensor 801 is formed by a conductive material such as titanium or a titanium compound whose heat resistance change ratio is not high. The temperature sensor is positioned closer to the heat generation element 130 than a conductive member 128 of a layer closest to the heat generation element 130 out of a plurality of conductive members in a wiring structure 120.

Before the temperature sensor 801 is formed, the upper surface of the insulating layer 802 is planarized by CMP or the like. Heat of the heat generation element 130 is transferred to the temperature sensor 801 via the insulating layer 802. It is therefore possible to improve the accuracy of the temperature sensor 801 by forming the thickness of the insulating layer 802 accurately. Another underlayer does not exist between the insulating layer 802 and the heat generation element 130, making it possible to form the insulating layer 802 having a uniform thickness accurately in a wafer surface. The temperature sensor 801 is formed before the conductive members in the wiring structure are formed, and thus the temperature sensor 801 may be annealed at a temperature equal to or higher than a critical temperature (for example, 400° C. or higher, 450° C. or higher, or 500° C. or higher).

Sixth Embodiment

An example of the arrangement of a discharge substrate 900 and a manufacturing method thereof according to the sixth embodiment will be described with reference to FIGS. 9A and 9B. A description of the same part as in the first embodiment will be omitted. A method of manufacturing the discharge substrate 900 is different from a method of manufacturing a discharge substrate 100 in method of manufacturing a substrate 300.

As shown in FIG. 9A, after a protective film 140 and a heat generation element 130 are formed on a base 301 as in the first embodiment, a protective film 901 is further formed on the protective film 140 and the heat generation element 130. The protective film 901 may be formed by the same material as the protective film 140 and may be annealed at a temperature equal to or higher than the critical temperature (for example, 400° C. or higher, 450° C. or higher, or 500° C. or higher, and more specifically, 650° C.) as in the protective film 140. Subsequently, the discharge substrate 900 shown in FIG. 9B is manufactured as in steps from FIG. 3B.

The discharge substrate 900 also includes the protective film 901 between the heat generation element 130 and a wiring structure 120, making it possible to suppress oxygen contained in the wiring structure 120 and a base 110 from being supplied to the heat generation element 130. This further suppresses oxidation of the heat generation element 130, implementing the long life of the discharge substrate 900.

Seventh Embodiment

An example of the arrangement of a discharge substrate 1200 and a manufacturing method thereof according to the seventh embodiment will be described with reference to FIGS. 11A to 12. The discharge substrate 1200 is different from a discharge substrate 100 in that it uses a substrate 1100 (FIG. 11C) instead of a substrate 300. In a description below, the same part as in the first embodiment will be omitted.

A method of manufacturing the discharge substrate 1200 will be described. As shown in FIG. 11A, a sacrificing layer 166 is formed on a base 301. Subsequently, as shown in FIG. 11B, a protective film 140 is formed on the base 301, and then a heat generation element 130 is formed on the protective film 140. The protective film 140 covers the entire surface of the sacrificing layer 166. The heat generation element 130 is arranged at a position overlapping a portion of the sacrificing layer 166. Subsequently, the substrate 1100 shown in FIG. 11C is formed as in FIGS. 3B to 3E of the first embodiment.

Then, as shown in FIG. 11D, the wiring structure of a substrate 200 and the wiring structure of the substrate 1100 are bonded to each other as in the first embodiment. Subsequently, as shown in FIG. 12, a water-repellent material 163 is formed on the base 301, an orifice 165 is formed, and the sacrificing layer 166 is removed via this orifice 165. The discharge substrate 1200 is manufactured as described above. The base 301 after the sacrificing layer 166 is removed forms a part of a channel 164 of a discharged liquid. According to this embodiment, an adherence layer 161 can be omitted as compared with the first embodiment, making it possible to omit a nozzle generation step.

Eighth Embodiment

An example of the arrangement of a discharge substrate 1300 and a manufacturing method thereof according to the eighth embodiment will be described with reference to FIGS. 13A and 13B. The discharge substrate 1300 is different from a discharge substrate 1200 in structure of a channel 164. A description of the same part as in the seventh embodiment will be omitted.

A method of manufacturing the discharge substrate 1300 will be described below. As shown in FIG. 11D, the method is the same as in the seventh embodiment until a step of bonding the wiring structure of a substrate 200 and the wiring structure of a substrate 1100 to each other. Subsequently, as shown in FIG. 13A, a base 301 is thinned so as to expose the upper surface of a sacrificing layer 166. This thinning may be performed by, for example, polishing.

Subsequently, as shown in FIG. 13B, the sacrificing layer 166 is removed, a nozzle member 162 is formed, a water-repellent material 163 is formed, and an orifice 165 is formed. The discharge substrate 1300 is manufactured as described above. A base 301 after the sacrificing layer 166 is removed forms a part of a channel 164 of a discharged liquid. According to this embodiment, an adherence layer 161 can be omitted as compared with the first embodiment, making it possible to omit a nozzle generation step.

Still Another Embodiment

FIG. 10A exemplifies the internal arrangement of a liquid discharge apparatus 1600 typified by an inkjet printer, a facsimile apparatus, a copy machine, or the like. In this example, the liquid discharge apparatus may be referred to as a printing apparatus. The liquid discharge apparatus 1600 includes a liquid discharge head 1510 that discharges a liquid (ink or a printing material in this example) to a predetermined medium P (a printing medium such as paper in this example). In this example, the liquid discharge head may be referred to as a printhead. The liquid discharge head 1510 is mounted on a carriage 1620, and the carriage 1620 can be attached to a lead screw 1621 having a helical groove 1604. The lead screw 1621 can rotate in synchronism with rotation of a driving motor 1601 via driving force transfer gears 1602 and 1603. Along with this, the liquid discharge head 1510 can move in a direction indicated by an arrow a orb along a guide 1619 together with the carriage 1620.

The medium P is pressed by a paper press plate 1605 in the carriage moving direction and is fixed to a platen 1606. The liquid discharge apparatus 1600 reciprocates the liquid discharge head 1510 and performs liquid discharge (printing in this example) on the medium P conveyed on the platen 1606 by a conveyance unit (not shown).

The liquid discharge apparatus 1600 confirms the position of a lever 1609 provided on the carriage 1620 via photocouplers 1607 and 1608, and switches the rotational direction of the driving motor 1601. A support member 1610 supports a cap member 1611 for covering the nozzles (liquid orifices or simply orifices) of the liquid discharge head 1510. A suction unit 1612 performs recovery processing of the liquid discharge head 1510 by sucking the interior of the cap member 1611 via an intra-cap opening 1613. A lever 1617 is provided to start recovery processing by suction, and moves along with movement of a cam 1618 engaged with the carriage 1620. A driving force from the driving motor 1601 is controlled by a well-known transfer mechanism such as clutch switching.

A main body support plate 1616 supports a moving member 1615 and a cleaning blade 1614. The moving member 1615 moves the cleaning blade 1614, and performs recovery processing of the liquid discharge head 1510 by wiping. A control unit (not shown) is also provided in the liquid discharge apparatus 1600, and controls driving of each mechanism described above.

FIG. 10B exemplifies the outer appearance of the liquid discharge head 1510. The liquid discharge head 1510 can include a head unit 1511 including a plurality of nozzles 1500, and a tank (liquid containing unit) 1512 that holds a liquid to be supplied to the head unit 1511. The tank 1512 and the head unit 1511 can be isolated at, for example, a broken line K, and the tank 1512 can be changed. The liquid discharge head 1510 includes an electrical contact (not shown) for receiving an electrical signal from the carriage 1620, and discharges a liquid in accordance with the electrical signal. The tank 1512 includes, for example, a fibrous or porous liquid holding member (not shown), and can hold a liquid by the liquid holding member.

FIG. 10C exemplifies the internal arrangement of the liquid discharge head 1510. The liquid discharge head 1510 includes a base 1508, channel wall members 1501 that are arranged on the base 1508 and form channels 1505, and a top plate 1502 having a liquid supply path 1503. As discharge elements or liquid discharge elements, heaters 1506 (electrothermal transducers) are arrayed on the substrate (liquid discharge head substrate) of the liquid discharge head 1510 in correspondence with the respective nozzles 1500. When a driving element (switching element such as a transistor) provided in correspondence with each heater 1506 is turned on, the heater 1506 is driven to generate heat.

A liquid from the liquid supply path 1503 is stored in a common liquid chamber 1504, and supplied to each nozzle 1500 through the corresponding channel 1505. The liquid supplied to each nozzle 1500 is discharged from the nozzle 1500 in response to driving of the heater 1506 corresponding to the nozzle 1500.

FIG. 10D exemplifies the system arrangement of the liquid discharge apparatus 1600. The liquid discharge apparatus 1600 includes an interface 1700, an MPU 1701, a ROM 1702, a RAM 1703, and a gate array (G.A.) 1704. The interface 1700 receives an external signal for performing liquid discharge from the outside. The ROM 1702 stores a control program to be executed by the MPU 1701. The RAM 1703 saves various signals and data such as the above-mentioned liquid discharge external signal and data supplied to a liquid discharge head 1708. The gate array 1704 performs supply control of data to the liquid discharge head 1708, and controls data transfer between the interface 1700, the MPU 1701, and the RAM 1703.

The liquid discharge apparatus 1600 further includes a head driver 1705, motor drivers 1706 and 1707, a conveyance motor 1709, and a carrier motor 1710. The carrier motor 1710 conveys the liquid discharge head 1708. The conveyance motor 1709 conveys the medium P. The head driver 1705 drives the liquid discharge head 1708. The motor drivers 1706 and 1707 drive the conveyance motor 1709 and the carrier motor 1710, respectively.

When a driving signal is input to the interface 1700, it can be converted into liquid discharge data between the gate array 1704 and the MPU 1701. Each mechanism performs a desired operation in accordance with this data, thus driving the liquid discharge head 1708.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A liquid discharge head substrate comprising:

a base where a semiconductor element is formed;

a first wiring structure positioned above the base;

a second wiring structure positioned above the first wiring structure; and a liquid discharge element positioned above the second wiring structure;

wherein a first surface of the first wiring structure and a second surface of the second wiring structure are bonded to each other, the first surface of the first wiring structure includes a first conductive portion, a first insulating portion, and a second insulating portion, the first conductive portion being positioned between the first insulating portion and the second insulating portion, the second surface of the second wiring structure includes a second conductive portion, a third insulating portion, and a fourth insulating portion, the second conductive portion being positioned between the third insulating portion and the fourth insulating portion, the first conductive portion and the second conductive portion are bonded to each other, the first insulating portion and the third insulating portion are bonded to each other, and the second insulating portion and the fourth insulating portion are bonded to each other.

2. The substrate according to claim 1, wherein the second wiring structure includes an insulating member and conductive members of a plurality of layers, the conductive members being positioned inside the insulating member, and a conductive member of a layer closest to the liquid discharge element out of the conductive members of the plurality of layers includes a conductive portion immediately below the liquid discharge element.

3. The substrate according to claim 1, wherein the second wiring structure includes an insulating member and conductive members of a plurality of layers, the conductive members being positioned inside the insulating member, and a conductive member of a layer closest to the liquid discharge element out of the conductive members of the plurality of layers does not include a conductive portion immediately below the liquid discharge element.

4. The substrate according to claim 1, wherein the second wiring structure includes an insulating member, conductive members of a plurality of layers, and a temperature sensor configured to measure a temperature of the liquid discharge element, the conductive members and the temperature sensor being positioned inside the insulating member, and the temperature sensor is positioned closer to the liquid discharge element than a conductive member of a layer closest to the liquid discharge element out of the conductive members of the plurality of layers is.

5. The substrate according to claim 4, wherein the temperature sensor overlaps with the liquid discharge element in a direction perpendicular to a surface of the base.

6. The substrate according to claim 1, further comprising a protective film positioned between the liquid discharge element and the second wiring structure.

7. The substrate to claim 1, wherein the liquid discharge element is a heat generation element.

8. A liquid discharge head comprising:

a liquid discharge head substrate defined in claim 1; and an orifice where discharge of a liquid is controlled by the liquid discharge head substrate.

9. A liquid discharge apparatus comprising:

a liquid discharge head defined in claim 8; and a supply means configured to supply a driving signal for causing the liquid discharge head to discharge a liquid.

10. A liquid discharge head substrate comprising:

a base where a semiconductor element is formed;

a wiring structure positioned above the base;

a liquid discharge element positioned above the wiring structure; and a protective film positioned above the liquid discharge element, wherein a surface of the protective film on a side of the liquid discharge element is flat.

11. The substrate according to claim 10, wherein the wiring structure has a first bonding surface between an insulating member and an insulating member, and a second bonding surface between a conductive member and a conductive member, and the first bonding surface and the second bonding surface are positioned on the same plane.

12. The substrate according to claim 10, wherein the wiring structure includes an insulating member and conductive members of a plurality of layers, the conductive members being positioned inside the insulating member, and a conductive member of a layer closest to the liquid discharge element out of the conductive members of the plurality of layers includes a conductive portion immediately below the liquid discharge element.

13. The substrate according to claim 10, wherein the wiring structure includes an insulating member and conductive members of a plurality of layers, the conductive members being positioned inside the insulating member, and a conductive member of a layer closest to the liquid discharge element out of the conductive members of the plurality of layers does not include a conductive portion immediately below the liquid discharge element.

14. The substrate according to claim 10, wherein the wiring structure includes an insulating member, conductive members of a plurality of layers, and a temperature sensor configured to measure a temperature of the liquid discharge element, the conductive members and the temperature sensor being positioned inside the insulating member, and the temperature sensor is positioned closer to the liquid discharge element than a conductive member of a layer closest to the liquid discharge element out of the conductive members of the plurality of layers is.

15. The substrate according to claim 14, wherein the temperature sensor overlaps with the liquid discharge element in a direction perpendicular to a surface of the base.

16. The substrate according to claim 10, further comprising another protective film positioned between the liquid discharge element and the wiring structure.

17. The substrate to claim 10, wherein the liquid discharge element is a heat generation element.

18. A liquid discharge head comprising:

a liquid discharge head substrate defined in claim 10; and an orifice where discharge of a liquid is controlled by the liquid discharge head substrate.

19. A liquid discharge apparatus comprising:

a liquid discharge head defined in claim 18; and a supply means configured to supply a driving signal for causing the liquid discharge head to discharge a liquid.

20. The substrate according to claim 1, further comprising a protective film positioned above the liquid discharge element.

* * * * *